US005155414A

United States Patent [19]

Sano

[11] Patent Number: 5,155,414

[45] Date of Patent: Oct. 13, 1992

[54] DRIVING METHOD OF PLASMA DISPLAY PANELS

[75] Inventor: Yoshio Sano, Tokyo, Japan

[73] Assignee: NEC Corporation, Tokyo, Japan

[21] Appl. No.: 713,380

[22] Filed: Jun. 10, 1991

[30] Foreign Application Priority Data

Jun. 8, 1990 [JP] Japan ..... 2-151055

[51] Int. Cl.[5] ..... G09G 3/10

[52] U.S. Cl. ..... 316/169.4; 340/771; 340/758

[58] Field of Search ..... 313/581, 584, 586; 340/758, 771, 781; 315/169.2, 169.4

[56] References Cited

U.S. PATENT DOCUMENTS 3,777,183 12/1973 Peters ..... 315/169.4

4,684,849 8/1987 Otsuka et al. ..... 315/169.4

*Primary Examiner*—Eugene R. LaRoche

*Assistant Examiner*—Michael B. Shingleton

[57] ABSTRACT

This invention concerns the driving method of AC-driven plasma display panels of dot matrix display type and is characterized in that scanning pulses of n number ($n \geqq 2$, an integer) are individually and separately applied to scanning electrodes during one period of sustain pulses applied to data or common electrodes. It is further characterized in that pixels which have been lit up with the scanning pulses of n number are simultaneously erased with erase pulses of n number.

4 Claims, 7 Drawing Sheets

H1
H2
S
E
D
0
-VH
VD
C1~Cm+1
S1
S2
S3
D1
(S1-D1)
DISCHARGE
CONDITION
time time
$C_1 \sim C_{m+1}$
S1
S2
S3
S4
S5
S6
$D_j$
H1
H2
S
E
D
Td
0
$-V_H$
$V_D$

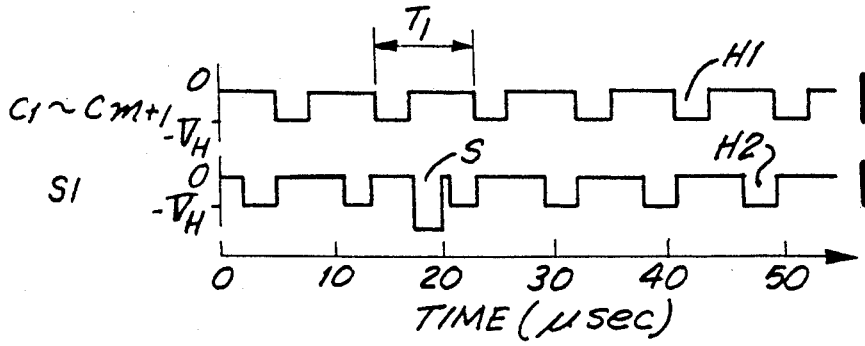
FIG.5A
FIG.5B
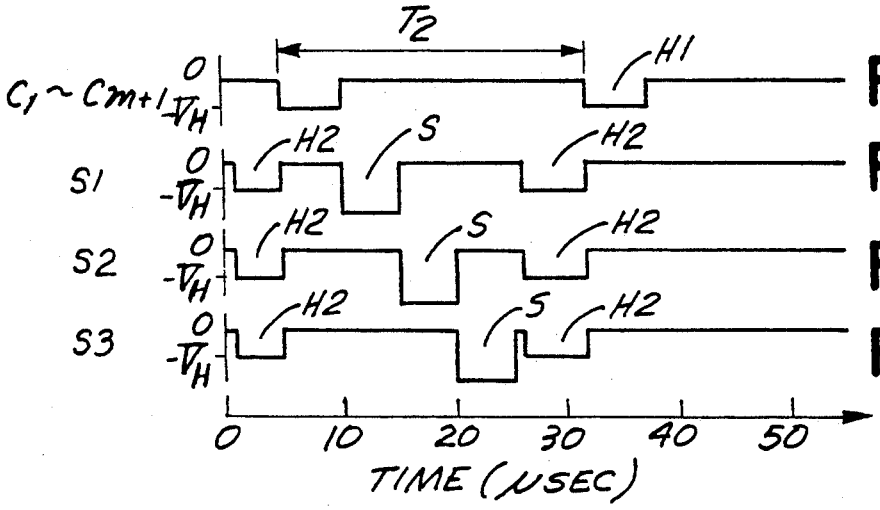
FIG.6A
FIG.6B
FIG.6C
FIG.6D time
H1
H2
E
S
D
Td
$C_1 \sim C_{m+1}$
S1
S2
S3
S4
S5
S6
$D_j$
0
$-V_H$
$V_H$
$V_D$

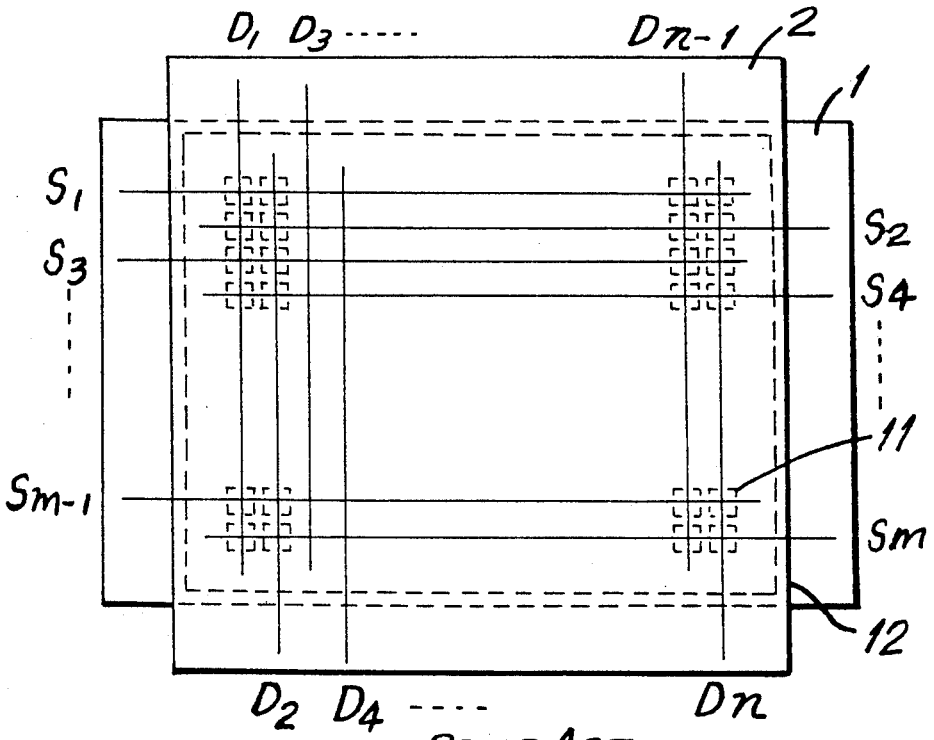
PRIOR ART
FIG. 8
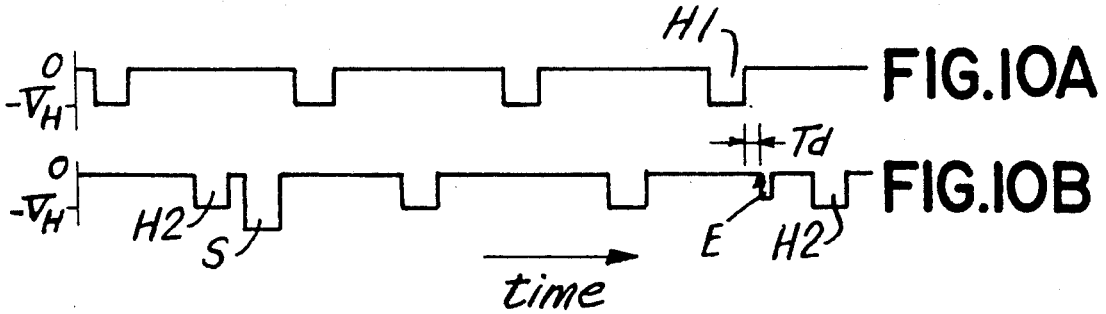
FIG.10A
FIG.10B
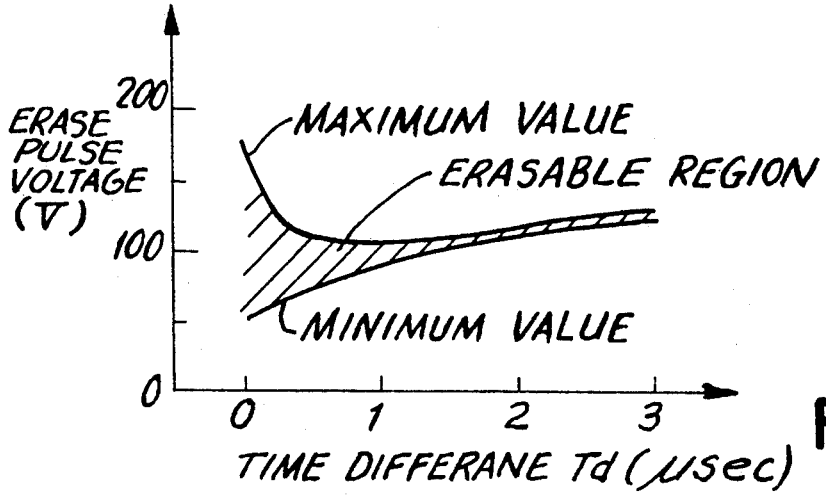
FIG.11 time
H1
H2
E
S
D
$V_D$
0
$-V_H$
$D_j$
S1
S2
S3
S4
S5
S6

DRIVING METHOD OF PLASMA DISPLAY PANELS

BACKGROUND OF THE INVENTION

This invention relates to a driving method of plasma display panels, and more particularly to a driving method of an AC-driven plasma display panel of dot-matrix display type.

According to the conventional driving method of such AC-driven plasma display panels, each row of scanning electrodes is applied with common periodical sustain pulse, and the each scanning electrode is separately applied line-sequentially with a scanning pulse and an erase pulse having the same polarity as the sustain pulse. Column electrodes which are arranged to oppose the scanning electrodes are applied with data pulses having the polarity opposite to the scanning pulses in correspondence to luminous display data. For example, when a positive data pulse is applied to a column electrode synchronously to the negative scanning pulse which is to be applied to a scanning electrode, electric glow discharge is produced within pixels at the crosspoint of the electrodes to emit light. The glow discharge is sustained while sustain pulses are being applied, but when a negative erase pulse of a narrow width and a lower voltage is applied on the scanning electrode, glow discharge is extinguished. Illumination of all the pixels are controlled over the entire screen by the above-mentioned method.

Scanning pulses are required in the number corresponding to the number of scanning lines in order to control glow discharge over a screen. But in order to prevent users from feeling flickers on the screen, the time for controlling illumination of one frame should be limited to about 1/60 sec. or less. As the conventional method inserts only one scanning pulse between the sustain pulses of one AC period, if a plasma display panel having a large number of scanning lines is to be driven, the frequency of the sustain pulses is inevitably increased.

For example, in order to display in 16 tones on a plasma display panel having 120 scanning electrodes, one frame is divided into four sub-frames which are weighted in the ratio of 8:4:2:1. If one frame needs 1/60 sec., the number of times necessary for scanning is $60\times4\times120=28{,}800$ times per second. The frequency of sustain pulses requires the same value. On the other hand, scanning should be conducted for each second, that is, $60\times4\times480=115{,}200$ times in order to drive a plasma display panel with the scanning lines of 480, and hence the frequency of sustain pulses should be increased by the same rate.

However, an increase in the frequency of sustain pulses entails number of inconveniences such that the luminance increases unnecessarily, the luminous efficiency decreases, and the panel is sometimes broken due to the strong distortion in the panel by the self-induced heat. Therefore, the frequency of sustain pulses cannot be increased freely.

When the frequency of the sustain pulses is increased, the width of the sustain pulses and of the scanning pulses becomes inevitably narrow. As the width of the sustain or the scanning pulses becomes narrow, discharge becomes instable. The pulse width should therefore be as wide as possible.

SUMMARY OF THE INVENTION

An object of this invention is to provide a driving method of a plasma display panel which can optimize the luminance and luminous efficiency irrespective of the number of scanning lines and which can select the frequency of sustain pulses so as to restrict the self-induced heat to that within a safe scope.

Another object of this invention is to realize the driving method of a plasma display panel which can secure wide width of sustain pulses and scanning pulses even if the number of scanning lines increases.

The driving method of plasma display panels according to this invention concerns the method for driving an AC-driven plasma display panel of dot matrix type having the memory function and is characterized in that scanning pulses of n number ($n\geqq2$, an integer) are respectively applied on scanning electrodes of n number in one to one relation during one period of sustain pulses of AC-driving. It is also characterized in that the pixels which are illuminated with the scanning pulses of n number are extinguished simultaneously with erase pulses of n number applied with the same timing.

This invention attempts to solve problems encountered in the prior art by using a novel driving method of the plasma display panels. In other words, according to this invention, instead of inserting one scanning pulse between two sustain pulses, scanning pulses of the number n (which is 2 or more) are individually and respectively inserted one each to the scanning electrodes of n number so that the frequency of the sustain pulses can be set at an optimal level irrespectively of the number of scanning lines to thereby secure luminance and luminous efficiency on the plasma display panel as well as to inhibit the heat generation.

BRIEF DESCRIPTION OF THE DRAWINGS

FIGS. 5A and 5B show voltage waveforms to explain specifically the applied voltage by the method of applicant's copending application Ser. No. 512,953;

FIGS. 6A through 6D show voltage waveforms to explain specifically an applied voltage by the first embodiment of this invention;

FIG. 8 is a schematic plan view to show the third embodiment driving method of this invention applied to a conventional plasma display panel;

FIGS. 10A and 10B show characteristics of the erase pulses to be used in the embodiments of this invention; and FIG. 11 shows the allowable characteristic scope of the erase pulse voltages as against the time difference Td between the sustain pulse and the erase pulse.

DESCRIPTION OF THE PREFERRED EMBODIMENTS

Figure 1:
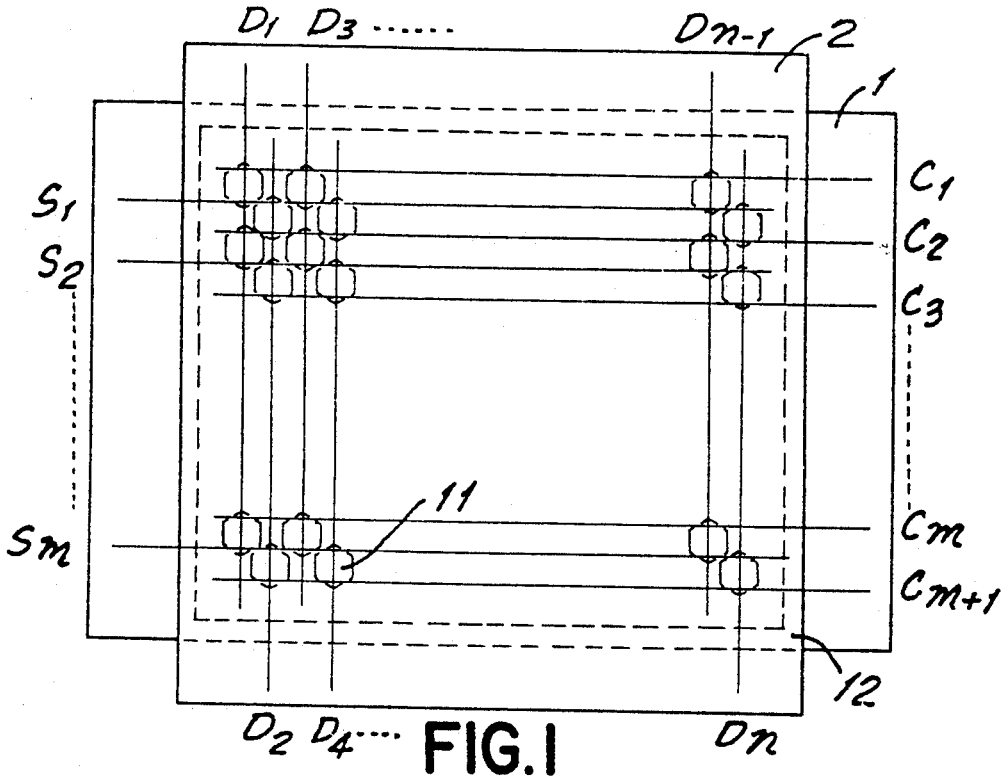
FIG. 1 is a schematic plane view of a plasma display panel to which the driving method according to one embodiment of this invention is applied.

This invention driving method will now be described referring to the case applied to the plasma display panel shown in FIGS. 1 and 2.

The driving method for the shown panel has been described in the copending U.S. patent application Ser. No. 07/512,953 by this applicant, and uses the driving waveforms shown in FIGS. 3A to 3E. First of all, the panel structure illustrated in the drawings is briefly described.

Figure 2A:
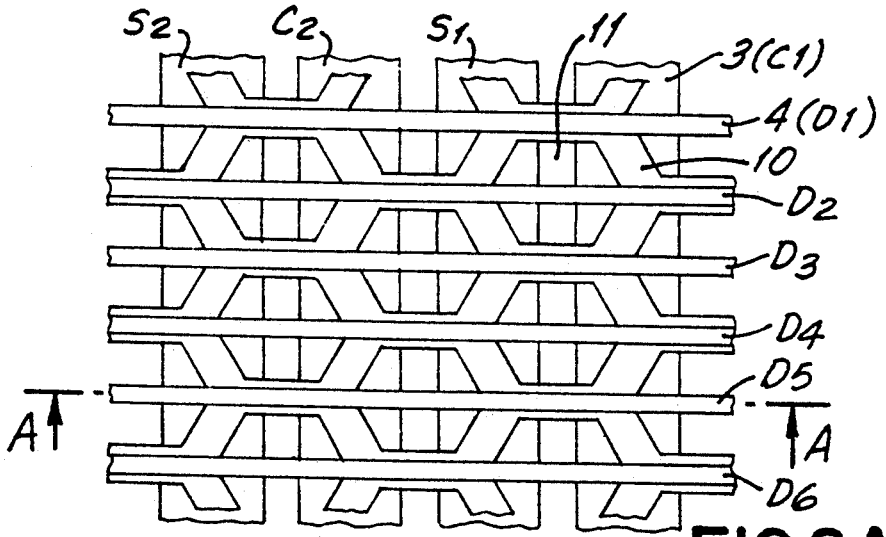
FIG. 2A is a partially enlarged plane view of FIG. 1.
Figure 2B:
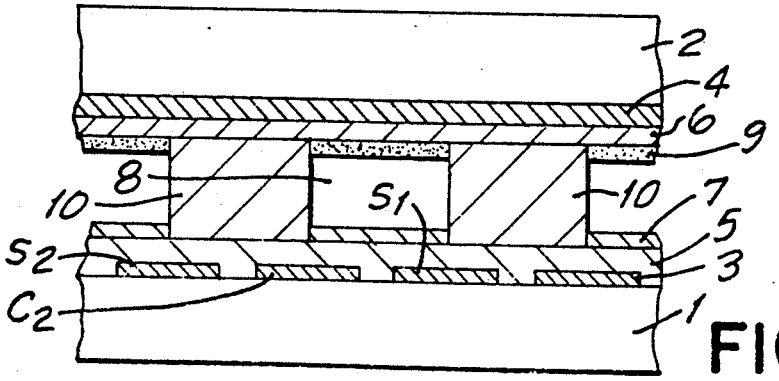
FIG. 2B is a cross section of FIG. 2A cut along the line A—A.

On a first insulation substrate 1 are arranged scanning electrodes $S_1$-$S_m$ and common electrodes $C_1$-$C_{m+1}$ alternately as row electrodes 3 ($C_1$-$C_{m+1}$) and covered by an insulation layer 5 and a protection layer 7 (FIGS. 2A and 2B). Column electrodes 4 ($D_1$-$D_6$) which oppose to the row electrodes 3 are formed on a second insulation substrate 2 and covered with an insulation layer 6. The row electrodes and the column electrodes are arranged to oppose each other via separator walls 10 to form discharge spaces 8. Photoluminescent phosphor members 9 are provided on insulation layer 6 on each of the discharge spaces.

Figures 3A, 3B, 3C, 3D, 3E, 3F:
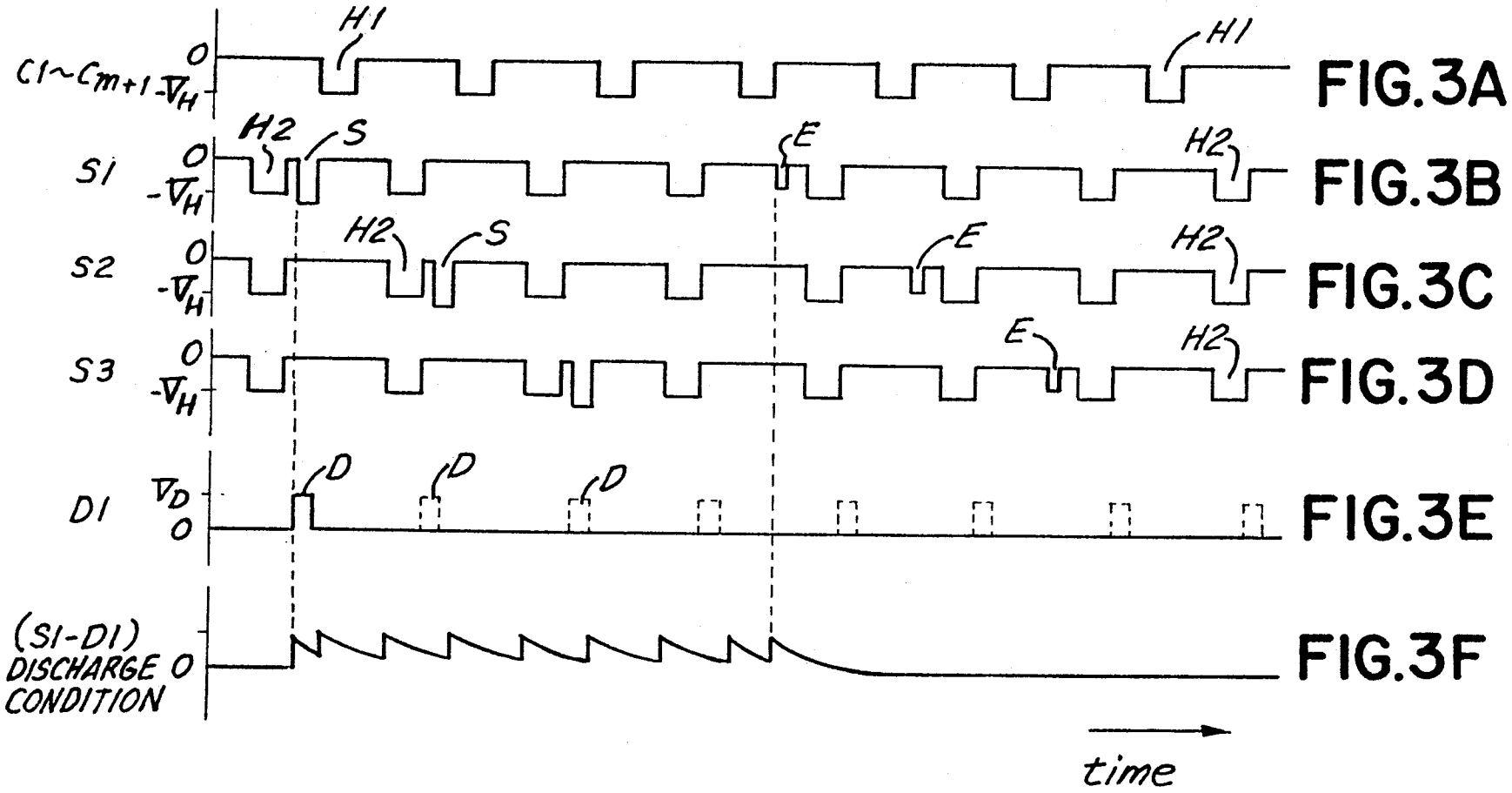
FIGS. 3A through 3E show voltage waveforms to explain the driven method of applicant's copending application Ser. No. 512,953 for driving the panel shown in FIGS. 1 and 2.
FIG. 3F shows a discharge waveform at a selected pixel according to the method shown in FIGS. 3A to 3E.

The driving method of the plasma display panel of the above described three-electrode structure comprises the steps of applying sustain pulses H1 of negative polarity on common electrodes $C_1$ through $C_{m+1}$ as shown in FIG. 3A. Each of the scanning electrodes $S_1$ through $S_m$ is applied with a common sustain pulse H2 of negative polarity and applied with a scanning pulse S and an erase pulse E individually and separately with linear sequence. (See FIGS. 3B through 3D). The column electrodes $D_1$ through $D_n$ are applied with positive data pulses in correspondence to the data to be displayed (FIG. 3E). For instance, in order to illuminate the pixels at a crosspoint between the scanning electrode S1 and the column electrode D1, as shown in FIG. 3E, a positive data pulse D is applied to the column electrode D1 synchronously to the scanning pulse S to be applied to the scanning electrode S1. Then, discharge takes place between the pixels to produce glow discharge. The glow discharge is sustained by applying the sustain pulses H1 and H2 as shown in FIG. 3F. When an erase pulse E of a narrow width and a low voltage is applied to the scanning electrode S1, the glow discharge is extinguished.

As shown above, according to the conventional driving method, only one scanning pulse exists between the two sustain pulses H1 as shown in FIG. 3A.

Figures 4A, 4B, 4C, 4D, 4E, 4F, 4G, 4H:
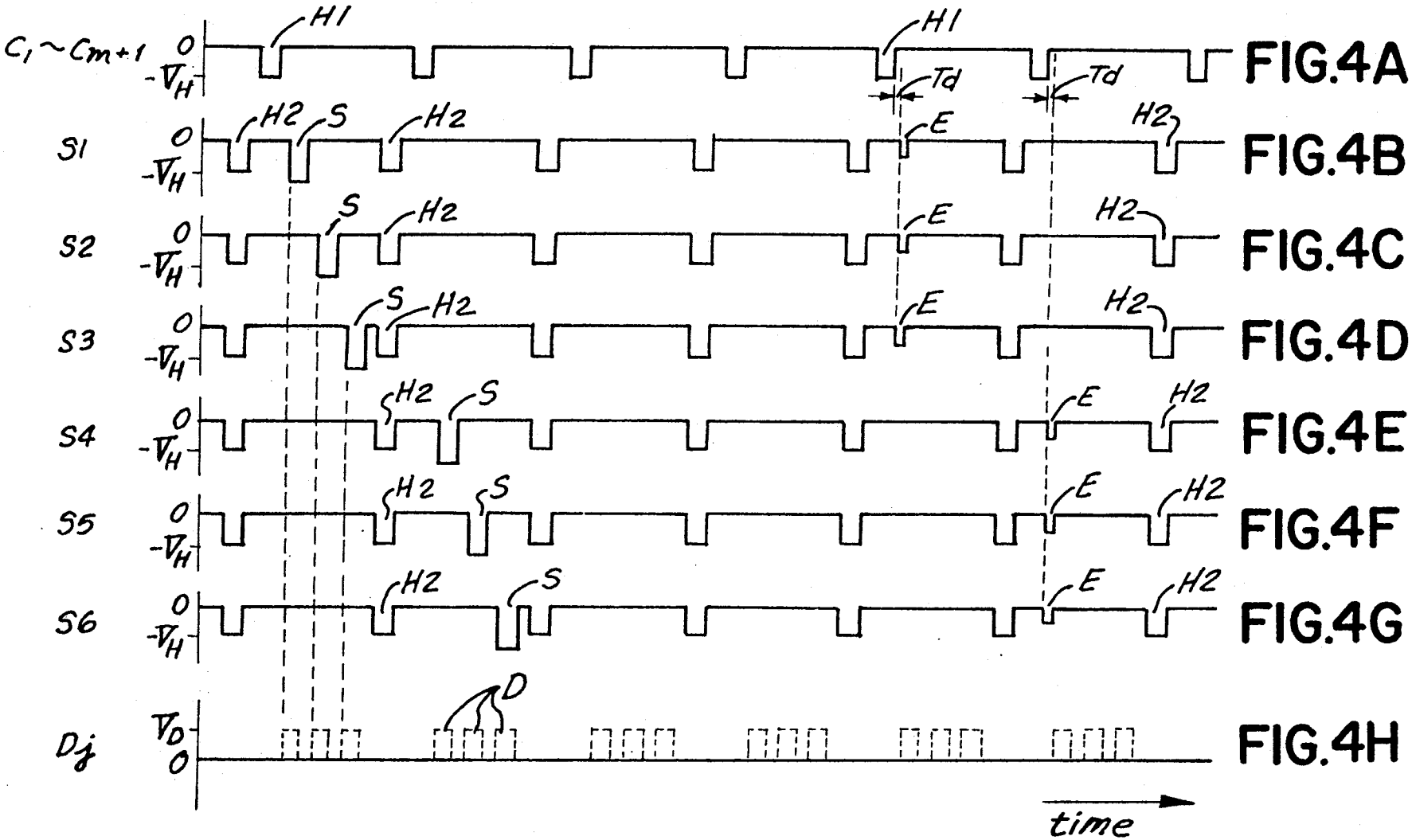
FIGS. 4A through 4H show voltage waveforms to explain the driving method according to the first embodiment of this invention.

Referring now to the first embodiment shown in FIG. 4, scanning pulses, sustain pulses and erase pulses are linear and are sequentially applied to each of the scanning electrodes $S_1$ through $S_m$ in a manner to position three scanning pulses between two sustain pulses H1 as shown in FIGS. 4B through 4G. Column electrodes are applied with data pulses in synchronization with the scanning pulse in correspondence to display data on column electrodes as shown in FIG. 4H. The reason why data pulses are illustrated with dotted lines in FIG. 4H is because they are different from other pulses in that while the sustain pulses, scanning pulses and erase pulses are steadily applied irrespective of the display pattern, data pulses are applied or not applied depending on the display patterns.

As mentioned in the foregoing, when 16-tone display is made on a panel of the scanning electrodes of 480, the frequency of sustain pulses has to be 115,200 Hz according to the method disclosed in applicant's copending application Ser. No. 512,953. According to the first embodiment of this invention shown in FIG. 4, three scanning pulses are positioned between two sustain pulses H1. Therefore the frequency of the sustain pulses is 38400 Hz or only one third of the above.

In FIG. 4, the pulse width of the sustain pulse H1, the sustain pulse H2 and the scanning pulse S is 5 μsec., and that of the erase pulse E is 0.7 μsec. The data pulses are applied and inserted to each column electrode in synchronization with these scanning pulses while erase pulses E are applied to the scanning electrodes $S_1$, $S_2$ and $S_3$ at the same timing. These erase pulses are inserted immediately after the sustain pulse H1 in the scope of Td=0 to 1 μsec. to thereby obtain a large allowable voltage width. The foregoing effect will be explained more in detail in reference to FIG. 10.

Comparing this embodiment with the method described in applicant's copending application Ser. No. 512,953 it is obvious that the method of this invention can reduce the frequency of the sustain pulses to one third of the needed frequency in the above-mentioned copending application. As the number of scanning pulses to be inserted between two sustain pulses H1 may be two or more, the frequency of the sustain pulses can be set at a value which can produce necessary luminance and luminous efficiency completely independent from the number of scanning lines or at a value which can fully inhibit heat generation advantageously.

This embodiment is also advantageous in that the width of sustain pulses or of scanning pulses may be set wider than in the above-mentioned application. As shown in FIG. 5A, because the conventional period $T_1$ of the sustain pulses is 1/115200=8.7 μsec., the width of the sustain or scanning pulses becomes inevitably 2.9 μsec. or less if divided uniformly. However, in the case of this invention method, as the sustain frequency is 38,400 Hz, the period $T_2$ of the sustain pulses becomes 1/38,400=26 μsec. as shown in FIG. 6A. If they are uniformly allocated between two sustain pulses and three scanning pulses contained within one period, the width of the sustain pulses and scanning pulses becomes 26/5=5.2 μsec. or the width as large as almost 1.8 times of the conventional width. This is quite beneficial as an increase in the width of the sustain pulses and scanning pulses greatly contributes to improving the stability in discharge.

Figures 7A, 7B, 7C, 7D, 7E, 7F, 7G, 7H:
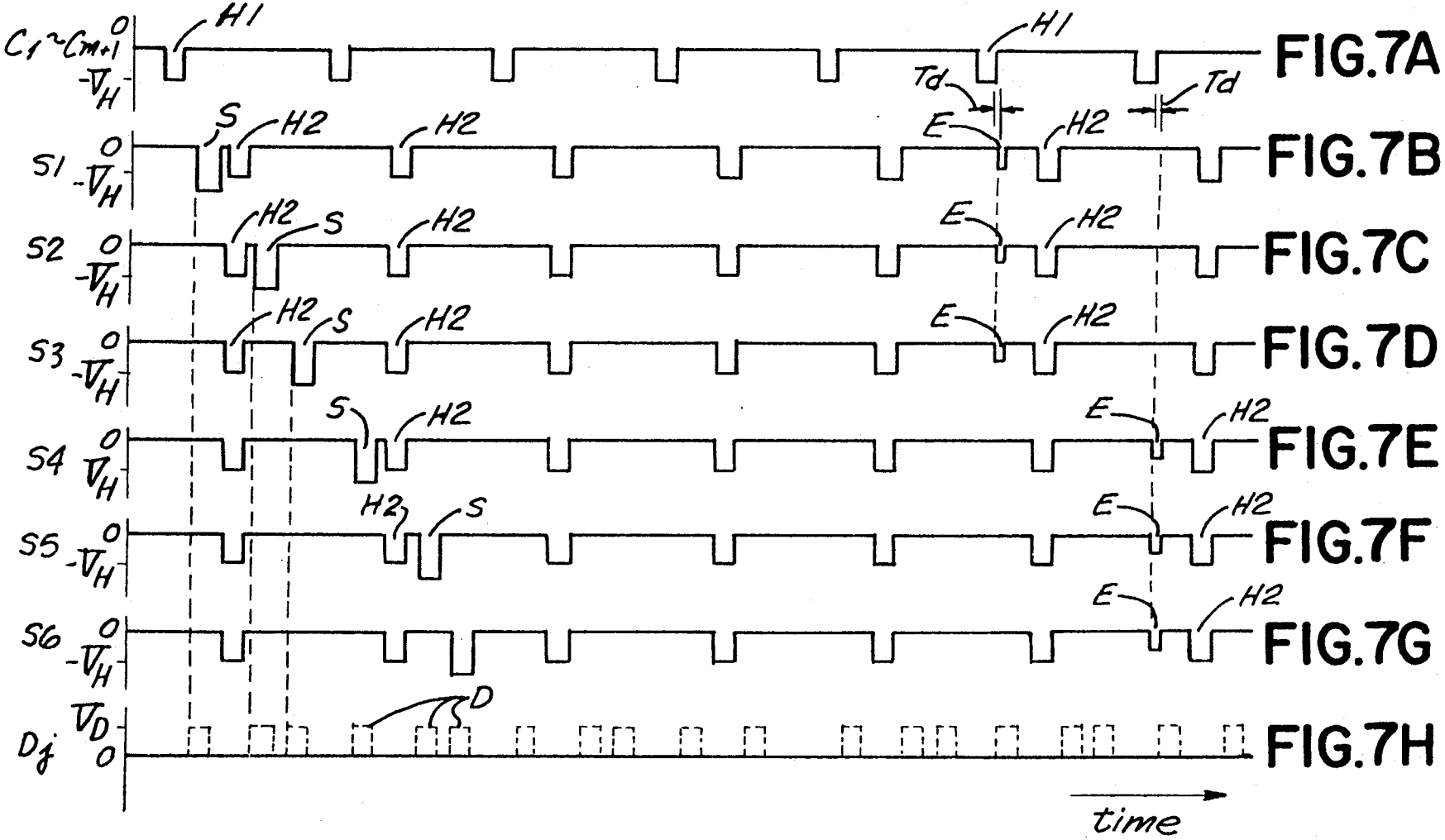
FIGS. 7A through 7H show voltage waveforms to explain the second embodiment of the driving method according to this invention.

The second embodiment of this invention will now be described by referring to FIG. 7. The plasma display panel used herein is the same panel as used in the first embodiment shown in FIGS. 1 and 2. The second embodiment is similar to the first embodiment in that three scanning pulses are inserted between two sustain pulses H1 as shown in FIGS. 7B through 7G, but is different in the position of the sustain pulses H2. The sustain pulses H2 may be positioned at any position between the sustain pulses H1 so long as it does not overlap with the erase pulse. Similar to the first embodiment, the data pulses are applied on the column electrodes in synchronization with the scanning pulses correspondingly to the display data.

Figures 9A, 9B, 9C, 9D, 9E, 9F, 9G:
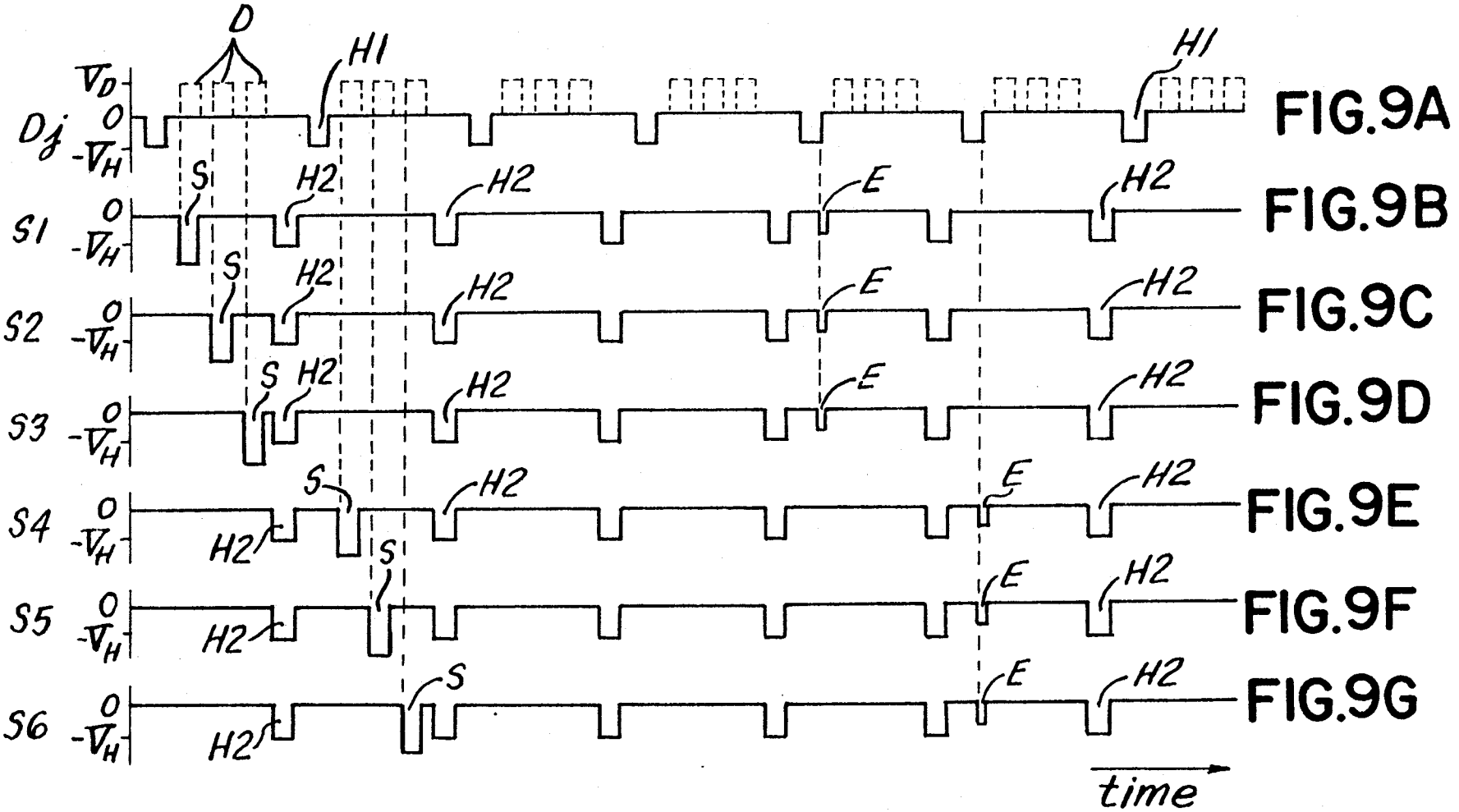
FIGS. 9A through 9G show voltage waveforms to explain the driving method according to the third embodiment of this invention.

The third embodiment of this invention will now be described referring to FIGS. 8 and 9. FIG. 8 shows a conventional plasma display panel to which the driving method of this invention is applied. As is obvious from FIG. 8, unlike the panel shown in FIGS. 1 and 2, the row electrodes in this panel are not divided into two groups but remain undivided as scanning electrodes $S_l$ through $S_m$. The crosspoints of scanning electrodes $S_1$ through $S_m$ and column electrodes $D_l$ through $D_n$ form pixels. In other words, the plasma display panel of FIG. 8 has long been known. The basic concept of the driving method for driving the panel or the third embodiment of this invention is similar to the first embodiment in waveforms as shown in FIG. 9, but the sustain pulse H1 is applied with data pulse to column electrodes unlike the first embodiment.

Scanning pulses are placed in a manner not to overlap with sustain pulses in any of the first to the third embodiments described above, but the arrangement is not limited to the above. One of the scanning pulses of n number may be multiplexed with the sustain pulse H2. The voltage waveforms shown in the first to the third embodiments may easily be realized with commerically available ICs.

When this invention driving method was applied to the practice, it was found quite effective to securely and simultaneously erase all the pixels which have been lit with the scanning pulses of n number by applying erase pulses with the same timing. This was because if the position of an erase pulse deviates timewise from a scanning line to a scanning line, the conditions of erase pulses become fluctuate to thereby incapacitate uniform erasing. More particularly, as shown in FIGS. 10A and 10B, if the time difference Td between a sustain pulse H1 and an erase pulse becomes larger, the allowable scope of erasing voltage becomes smaller to practically incapacitate erasing as shown in FIG. 11. As is obvious from FIG. 11, the allowable scope of erase voltage becomes larger as the time difference Td becomes smaller. Therefore, the time difference Td should be set as small as possible.

This invention method permits setting of the frequency of sustain pulses which used to be automatically determined by the number of the scanning lines irrespective of the number of scanning lines. This invention is quite advantageous practically as the frequency of the sustain pulses may be set at an optimal value which permits effective luminance or luminous efficiency at a value within a scope which fully inhibits heat generation.

As mentioned in relation to the first embodiment, this invention allows to set the width of sustain pulses or scanning pulses wider than before, and can improve safety in discharge. Hence, operational stability improves remarkably on the plasma display panel, and has a high practical value.

What is claimed is:

1. A driving method of AC-driven plasma display panels of the dot matrix display type, the method comprising the steps of providing plasma display panels each including a first substrate having a first electrode group and a second electrode group arranged thereon wherein each electrode of said second electrode group is interposed between adjacent ones of electrodes of the first electrode group, and a second substrate opposed to said first substrate and having a third electrode group arranged thereon; applying first sustain pulses periodically to said first electrode group arranged on said first substrate; applying scanning pulses sequentially to said second electrode group arranged on said first substrate; applying second sustain pulses to said second electrode group at a timing different from that of said first sustain pulses, said scanning pulses being applied to a predetermined plural numbers of electrodes of said second electrode group with a different timing with respect to each other during an interval between adjacent pulses of said first sustain pulses; applying erase pulses to said predetermined plural numbers of electrodes of said second electrode group with the same timing with respect to each other; and applying data pulses to said third electrode group arranged on said second substrate opposed to said first substrate in synchronism with said scanning pulses.

2. A driving method of AC-driven plasma display panels of the dot matrix display type, the method comprising the steps of providing plasma display panels each including a first substrate having a first electrode group arranged thereon and a second substrate having a second electrode group arranged thereon so as to oppose said first electrode group; applying first sustain pulses periodically to said first electrode group arranged on said first substrate; applying scanning pulses sequentially to said second electrode group arranged on said second substrate; applying second sustain pulses to said second electrode group at a timing different from that of said first sustain pulses, said scanning pulses being applied to a predetermined plural numbers of electrodes of said second electrode group with a different timing with respect to each other during an interval between adjacent pulses of said first sustain pulses; applying erase pulses to said predetermined plural numbers of electrodes of said second electrode group with the same timing with respect to each other; and applying data pulses to said first electrode group in synchronism with said scanning pulses.

3. A driving method of plasma display panels comprising the steps of providing plasma display panels each including a first substrate having a scanning electrode group arranged thereon, a second substrate opposed to said first substrate and having a data electrode group arranged thereon and a sustain electrode group arranged thereon such that each electrode of said sustain electrode group is interposed between adjacent electrodes of said scanning electrode group; applying sequentially scanning pulses to each electrode of said scanning electrode group arranged on said first substrate; applying data pulses to said data electrode group arranged on said second substrate opposed to said first substrate in synchronism with said scanning pulses so as to cause discharge between said scanning electrode group and said data electrode group; applying first sustain pulses to one of said data electrode group and said sustain electrode group; and applying second sustain pulses to said scanning electrode group at a timing different from that of said first sustain pulses, said scanning pulses being applied to a plurality of electrodes of said scanning electrode group with different timing with respect to each other during an interval between adjacent pulses of said first sustain pulses.

4. The driving method of plasma display panels as defined in claim 3, and further comprising the step of applying erase pulses to said plurality of electrodes of said scanning electrode group with the same timing with respect to each other.

* * * * *